US005822972A

United States Patent [19]

Patelke et al.

[11] Patent Number: 5,822,972

[45] Date of Patent: Oct. 20, 1998

[54] AIR CURTAIN NEP SEPARATION AND DETECTION

[75] Inventors: David B. Patelke, Knoxville; Gordon F. Williams, Norris; Michael E. Galyon; Hossein M. Ghorashi, both of Knoxville, all of Tenn.

[73] Assignee: Zellweger Uster, Inc., Knoxville, Tenn.

[21] Appl. No.: 885,588

[22] Filed: Jun. 30, 1997

[51] Int. Cl.[6] ..... D01H 4/00

[52] U.S. Cl. ..... 57/408; 57/301; 57/304; 57/311; 19/98; 19/200

[58] Field of Search ..... 57/301, 304, 408, 57/411; 19/200, 205, 105, 98, 99, 107

[56] References Cited

U.S. PATENT DOCUMENTS

| | | | |
|---|---|---|---|
| 3,959,961 | 6/1976 | Stahlecker | 57/56 |
| 3,986,327 | 10/1976 | Kobayashi | 57/56 |
| 4,009,562 | 3/1977 | Stalder | 57/56 |
| 4,249,370 | 2/1981 | Vecera et al. | 57/301 |
| 4,499,718 | 2/1985 | Junek et al. | 57/301 |
| 4,512,060 | 4/1985 | Shofner | 19/200 |
| 4,522,023 | 6/1985 | Stahlecker | 57/401 |
| 4,543,779 | 10/1985 | Wassenhoven | 57/401 |
| 4,557,105 | 12/1985 | Brockmanns et al. | 57/401 |
| 4,631,781 | 12/1986 | Shofner | 19/200 |
| 4,686,744 | 8/1987 | Shofner | 19/200 |
| 4,852,340 | 8/1989 | Kotrba et al. | 57/301 |
| 4,869,060 | 9/1989 | Stewart et al. | 57/301 |
| 4,901,519 | 2/1990 | Wassenhoven et al | 57/411 |
| 4,953,265 | 9/1990 | Sheinhutte | 19/297 |
| 5,303,455 | 4/1994 | Leifeld | 19/200 |
| 5,356,450 | 10/1994 | Leth Moller et al. | 65/456 |
| 5,361,574 | 11/1994 | Gebhardt | 57/408 |
| 5,414,990 | 5/1995 | Blazek et al. | 57/411 |
| 5,454,219 | 10/1995 | Raasch | 57/301 |
| 5,481,862 | 1/1996 | Wassenhoven | 57/301 |
| 5,539,515 | 7/1996 | Shofner et al. | 356/238 |
| 5,642,553 | 7/1997 | Leifeld | 19/98 |

FOREIGN PATENT DOCUMENTS

| | | | |
|---|---|---|---|
| 2225634 | 6/1990 | United Kingdom | 19/98 |

*Primary Examiner*—William Stryjewski
*Attorney, Agent, or Firm*—Luedeka, Neely & Graham, P.C.

[57] ABSTRACT

A nep separator and detector for presenting a fiber sample having fibers, neps, and trash. A toothed rotating cylinder receives the fiber sample at a fiber sample receiving point, and impacts and propels at least a portion of the trash and neps along an ejection path. An air curtain is directed toward and passes across a portion of the toothed surface of the rotating cylinder, at a location rotationally after the fiber sample is received by the toothed rotating cylinder. The air curtain crosses and is oriented transverse to the ejection path, and draws at least a portion of the neps out of the ejection path and onto the surface of the toothed cylinder as it rotates. The trash propelled by impact with the toothed rotating cylinder has sufficient momentum to pass through the air curtain along the ejection path. A dead air space is positioned in the ejection path and disposed adjacent the air curtain and across the air curtain from the fiber sample receiving point. The trash propelled by the toothed rotating cylinder passes through the dead air space. A nep air stream draws the neps on the surface of the toothed cylinder off the surface of the toothed cylinder at a nep release point, and the neps are entrained in the nep air stream. A sensor detects the neps entrained in the nep air stream, and produces a nep detection signal upon the occurrence of each detection of a nep. An output receives the nep detection signals produced by the sensor and produces output signals corresponding to the nep detection signals.

19 Claims, 2 Drawing Sheets

AIR CURTAIN NEP SEPARATION AND DETECTION

FIELD OF THE INVENTION

This invention relates to the field of fiber processing. More particularly the invention relates to the field of separating and detecting neps within a fiber sample.

BACKGROUND OF THE INVENTION

Fibers, such as cotton, are subject to entanglements called neps. Neps are clusters of one or more fibers having a knotted mass. A nep may be naturally occurring, such as an entanglement of fibers on a seed shell, or may be mechanically produced during handling or processing of the fibers.

Different articles for which the fibers are used tend to have different tolerance levels for the number of neps within a given amount of the fiber. For example, it is desired to have very few neps, or no neps, in a batch of cotton fibers that are to be used for the production of a pin-point cotton fabric, such as is used for shirts. On the other hand, a large amount of neps may be tolerated, and even preferred, in a sample of fibers that is to be used for the production of a filter.

Thus, buyers, sellers, and processors dealing in fiber need to have some method for testing and grading a sample of fibers as to nep content. Such a method could be used to classify the fibers as to grade at the time that they are sold, so that both the buyer and seller would know the relative worth of the fibers as to their intended purpose. Such a method could also be used by processors during carding and other processes to measure the reduction of neps through the processing. In addition, such a method could be used to monitor the performance of processing machines, to determine whether the machines were increasing the number of neps in the fibers.

While equipment is available which will determine the characteristics of a fiber sample, such equipment typically analyzes the sample for a multiplicity of characteristics, such as size and type of neps, trash content, length of fibers, fiber color, fiber strength, moisture content, etc. While this amount of information can be valuable when it is all needed, the ability to analyze the fiber sample so completely tends to increase both the size and cost of the equipment required. In addition, extensive training may be required to master the set-up, calibration, and operation of such equipment.

What is needed, therefore, is a low-cost, quick, simple, and readily transportable method and apparatus for counting the number of neps in a fiber sample.

SUMMARY OF THE INVENTION

The above and other needs are answered by a nep separator and detector. Means are provided for presenting a fiber sample having fibers, neps, and trash. A toothed rotating cylinder receives the fiber sample at a fiber sample receiving point, and impacts and propels at least a portion of the trash and neps along an ejection path.

An air curtain is directed toward and passes across a portion of the toothed surface of the rotating cylinder, at a location rotationally after the fiber sample is received by the toothed rotating cylinder. The air curtain crosses and is oriented transverse to the ejection path, and draws at least a portion of the neps out of the ejection path and onto the surface of the toothed cylinder as it rotates. The trash propelled by impact with the toothed rotating cylinder has sufficient momentum to pass through the air curtain along the ejection path.

A dead air space is positioned in the ejection path and disposed adjacent the air curtain and across the air curtain from the fiber sample receiving point. The trash propelled by the toothed rotating cylinder passes through the dead air space. A nep air stream draws the neps on the surface of the toothed cylinder off the surface of the toothed cylinder at a nep release point, and the neps are entrained in the nep air stream. A sensor detects the neps entrained in the nep air stream, and produces a nep detection signal upon the occurrence of each detection of a nep. Output means receive the nep detection signals produced by the sensor and produce output signals corresponding to the nep detection signals.

In this manner, trash is propelled out of the fiber sample and away from the toothed cylinder. The air curtain tends to direct neps and fibers of the fiber sample into the toothed cylinder, where they are eventually conducted to the sensor for measurement. The trash propelled out of the sample typically has sufficient momentum to shoot through the air curtain, so that it is not brought back into the fiber sample that goes on to the sensor. After passing through the air curtain, the trash enters a dead air space, which is placed in that location so that, among other purposes, as the trash decelerates, it is not drawn back into the air curtain and mixed back into the fiber sample.

This apparatus effectively removes the trash from the fiber sample in a way that tends to be destructive of the fibers in the sample. However, fiber integrity is not of the upmost importance when a nep count is desired. Thus, this method is relatively inexpensive when compared to other fiber, trash, and nep separation methods, which place a higher priority on maintaining fiber integrity. In addition, an apparatus according to the present invention is quite simple and does not require extensive calibration. Further, it can be made quite small, so that it can fit on a cart and be easily transported. Additionally, because it is relatively easy to manufacture an apparatus according to the present invention, and such an apparatus requires relatively unsophisticated electronics, it is typically less expensive than other units.

In the preferred embodiment a trash removal volume is disposed adjacent the dead air space (preferably below the dead air space) and across the dead air space from the air curtain at a location along the ejection path. The trash removal volume receives the trash passing through the dead air space, that has been propelled through the air curtain. A trash air stream enters the trash removal volume, entrains the trash received in the trash removal volume, and exits the trash removal volume with the trash entrained. The trash entrained in the trash air stream is thus conducted out of the trash removal volume.

The preferred means for presenting the fiber sample includes a rotating feed roller, which is disposed proximate the toothed rotating cylinder. The rotating feed roller and the toothed rotating cylinder both rotate in the same direction, meaning either clockwise or counterclockwise. With the roller and the cylinder rotating in this manner, the adjacent surfaces of the rotating feed roller and toothed rotating cylinder pass each other in opposite directions.

The teeth on the toothed rotating cylinder of the preferred embodiment are disposed at an angle forward from normal, relative to the direction of rotation of the toothed rotating cylinder. In this manner the teeth lean into the direction of rotation, so to speak, which tends to aid in drawing the fiber sample along the surface of the toothed rotating cylinder. The toothed rotating cylinder preferably has a solid surface, and rotates at a speed of about 6,000 rotations per minute. This speed is destructive of the fibers in the fiber sample, but again the integrity of the fibers is not the primary objective. This speed tends to be effective at impacting the teeth of the cylinder against the trash of the fiber sample, and propelling the trash through the air curtain.

A carding flat is preferably disposed adjacent the toothed rotating cylinder at a position between the fiber sample receiving point and the nep release point. The carding flat cards the neps on the surface of the toothed cylinder. At the speeds mentioned above, the carding flat is also destructive to the fibers.

The preferred sensor has a light source disposed adjacent the nep air stream, which illuminates the neps entrained in the nep air stream in a direction transverse to the direction of the nep air stream. The illuminated neps cast shadows in the illumination, the shadows having an amplitude component and a time duration component. A light detector is disposed adjacent the nep air stream and across the nep air stream from the light source, and it detects the illumination and the shadows cast by the neps in the illumination. The light detector produces nep detection signals corresponding to the amplitude and time duration components of the shadows. The output means has means for comparing the amplitude and time duration components of the nep detection signals against predetermined limits. A count of the neps detected is incremented when the amplitude component of the nep detection signals is at least equal to a first predetermined limit and the time duration component of the nep detection signals is no greater than a second predetermined limit.

The neps tend to cast a larger or darker shadow than the now-fragmented fibers in the fiber sample. By using simple predetermined thresholds to detect the neps, rather than complex algorithms, an apparatus according to the preferred embodiment of the present invention is able to use less sensitive, and therefore less expensive output means than those devices which attempt to determine the exact size of the neps and the fibers. Thus, such an apparatus according to the present invention will produce a count of the number of neps in the fiber sample that was provided. An operator can feed in samples of a given amount from several different pieces of fiber processing equipment, or from the same piece of equipment over a period or time, such as before and after a maintenance procedure, and know how the normalized nep count has changed.

In a preferred embodiment of a method according to the present invention, of separating and detecting neps in a fiber sample having fibers, neps, and trash, the fiber sample is presented with a fiber sample presenting means, and received at a fiber sample receiving point with a toothed rotating cylinder. At least a portion of the trash and neps are propelled along an ejection path by the teeth of the rotating cylinder. An air curtain crosses and is oriented transverse to the ejection path. The air curtain is directed toward and passes across a portion of the toothed surface of the rotating cylinder at a location rotationally after the fiber sample is received by the toothed rotating cylinder. At least a portion of the neps in the fiber sample are drawn out of the ejection path and onto the toothed cylinder as it rotates.

The trash is propelled with sufficient momentum to pass through the air curtain along the ejection path, thereby passing through a dead air space disposed adjacent the air curtain and across the air curtain from the fiber sample receiving point, in the ejection path. The trash passing through the dead air space is received in a trash removal volume, which is disposed adjacent the dead air space and across the dead air space from the air curtain along the ejection path, where the trash is entrained in a trash air stream and conducted out of the trash removal volume.

The neps on the surface of the toothed rotating cylinder are carded with a carding flat disposed adjacent the toothed rotating cylinder, and are drawn off the surface of the toothed cylinder with a nep air stream at a nep release point and entrained in the nep air stream. The neps entrained in the nep air stream are illuminated in a transverse direction with a light source disposed adjacent the nep air stream, thereby casting shadows in the illumination having an amplitude component and a time duration component. The illumination and the shadows cast by the neps in the illumination are detected with a light detector disposed adjacent the nep air stream and across the nep air stream from the light source. The light detector produces nep detection signals corresponding to the amplitude and time duration components, which are compared against predetermined limits. A count of neps detected is incremented when the amplitude component of the nep detection signals is at least equal to a first predetermined limit and the time duration component of the nep detection signals is no greater than a second predetermined limit.

BRIEF DESCRIPTION OF THE DRAWINGS

Further advantages of the invention will become apparent by reference to the detailed description of preferred embodiments when considered in conjunction with the following drawings, which are not to scale, in which like reference numerals denote like elements throughout the several views, and wherein.

DETAILED DESCRIPTION OF THE INVENTION

Figure 1:
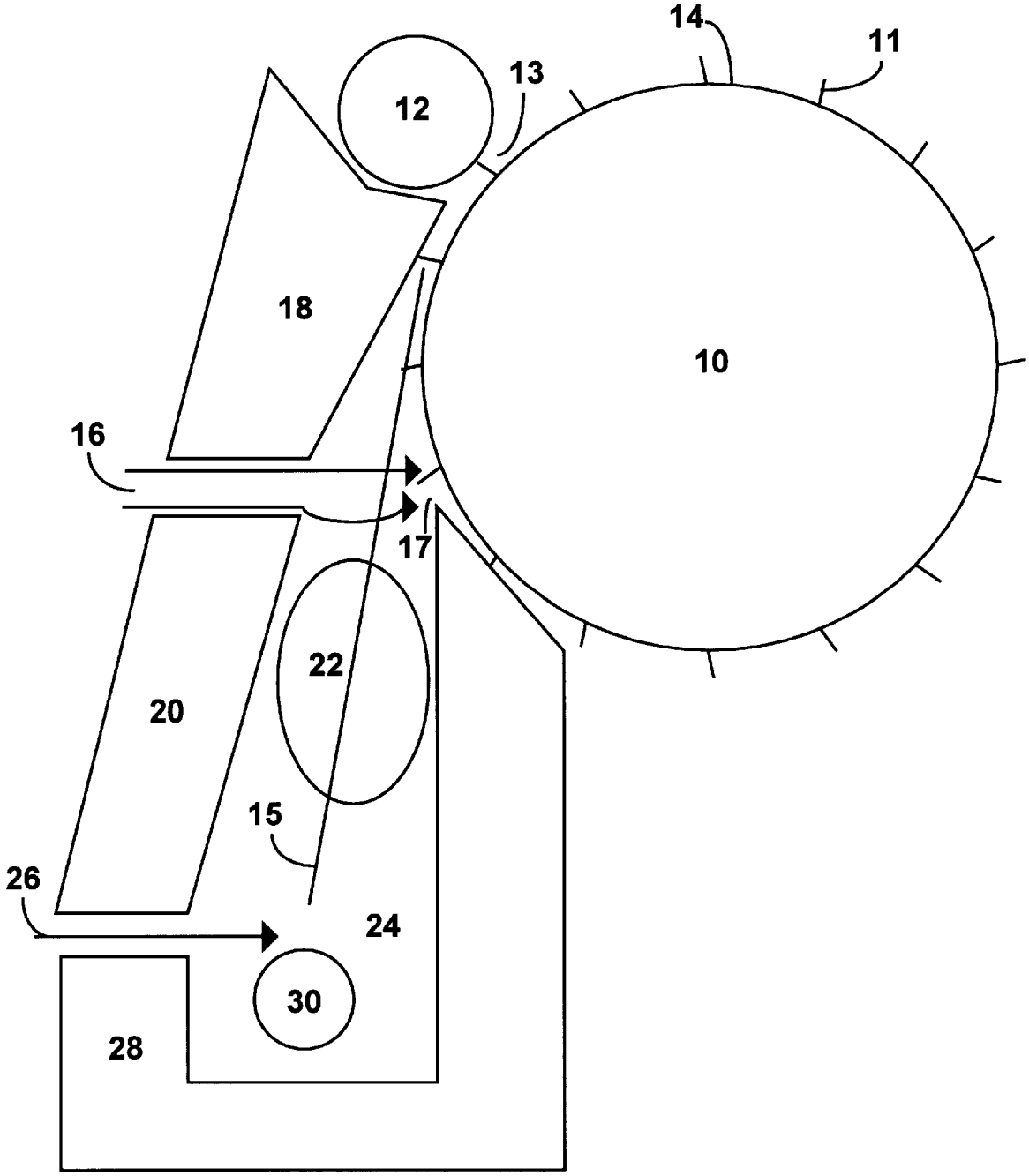
FIG. 1 is an enlarged view of a portion of an embodiment of the invention, depicting the detail of the fiber sample receiving point and other elements along the ejection path.

Referring now to the drawings, there is depicted in FIG. 1 an embodiment of a portion of a nep separator and detector according to the invention. A fiber sample is introduced to the separator with a presenting means, which in the embodiment depicted is a feed roller 12 which draws the fiber sample along block 18, and presents the fiber sample at a fiber sample receiving point 13. The fiber sample preferably includes fibers, in which an amount of trash may be mixed. There may also be neps, or tangled masses of fibers, in with the unentangled fibers. It is one of the objects of the invention to at least partially separate these neps from some of the other components of the fiber sample, and then detect and preferably count the neps.

A toothed rotating cylinder 10 receives the fiber sample at fiber sample receiving point 13. The surface of the cylinder 10 is solid. The cylinder 10 preferably has a diameter of about 62 cm and width of about 26 cm. The teeth 11 on the cylinder 10 are preferably raked at an angle of about 9 degrees forward of the direction of rotation, which in the embodiment depicted in FIG. 1 is counter-clockwise. In a preferred embodiment, there would be more teeth 11 on the cylinder 10 than depicted, and the teeth would be disposed closer together around the circumference of the cylinder 10. The teeth 11 have been so depicted in FIG. 1 so as to not unduly complicate the figure. Preferably the teeth have a diameter of about 0.03 inches, a height of about 0.074 inches, and a density of about 100 teeth per inch.

Preferably, the feed roller 12 is rotating in the same direction as the cylinder 10, which in this example is counter-clockwise. In this configuration, the surface 14 of the cylinder 10 and the surface of the feed roller 12 are moving in opposite directions where they pass each other at fiber sample receiving point 13. The cylinder 10 is preferably rotating at speed of approximately 6,000 rotations per minute. At this speed, and with the fiber sample being introduced by the feed roller 12 in a direction against the direction of rotation of the cylinder 10, the fibers of the fiber sample may be torn, broken, and sheared as they are presented. Thus, this apparatus, operating at this speed, would not typically be appropriate for a device that was used for processing sellable fibers in a production environment. Therefore, an apparatus according to the present invention is designed more for testing fiber samples for neps, and less for separating good fibers from the other components of the fiber sample.

The teeth 11 of the cylinder 10 tend to engage and hold the fibers and neps of the fiber sample, but the trash in the fiber sample tends to be propelled away from the surface 14 of the cylinder 10 by the force of impact with the teeth 11. This impact tends to impart sufficient momentum to the trash to propel it along a ejection path 15. It will be appreciated that even though ejection path 15 is depicted as a line, there is no actual line, but this is merely a representation of the approximate trajectory of a trash particle that has been propelled by the teeth 11 on the rotating spinning cylinder 10. Fibers and neps may also tend to follow the first portion of the ejection path 15.

An air curtain 16 is introduced into the separator, such as between blocks 18 and 20, and passes across a portion of the surface 14 of the cylinder 10. As depicted, the air curtain 16 blows against the cylinder 10 at a position 17 that is rotationally after the fiber sample receiving point 13, and the direction and orientation of the air curtain 16 is generally transverse to the ejection path 15. The air curtain 16 tends to urge at least a portion of the neps that are engaged in the teeth 11 and against the surface 14 of the cylinder 10 to remain so engaged, and draws them along the surface 14 of the cylinder 10 as it rotates past block 28 at point 17. The air curtain 16 also tends to blow back any of the neps that initially followed ejection path 15, and draw them along the surface 14 of the cylinder 10 as well.

However, the trash that is traveling along ejection path 15, because it typically has a greater mass or density than the neps, tends to have sufficient momentum to pass through the air curtain 16 and further along the ejection path 15. The next region encountered by the trash traveling along the ejection path 15 is a dead air space 22, which is disposed adjacent the air curtain 16, across from the fiber sample receiving point 13. One purpose of the dead air space 22 is to provide a buffer, such that anything which enters it, such as trash, will be in a relatively aerodynamically quiet or still area, and will not be drawn back into and along the air curtain 16.

Further along the ejection path 15, adjacent the dead air space 22 and across from the air curtain 16, is a trash removal volume 24, which receives the trash that is propelled along the ejection path 15. A trash air stream 26 enters the trash removal volume 24, such as through the port defined between blocks 20 and 28, and entrains the trash received in the trash removal volume 24. The trash air stream 26 is drawn off, such as through port 30, and exits the trash removal volume 24, conducting the trash entrained in it out of the trash removal volume 24 as it exits.

In this manner, the trash in the fiber sample, which tends to have sufficient size so as to be later confused with the neps, as described more fully below, is removed from the neps in the fiber sample. First the trash is propelled out of the fiber sample along ejection path 15 by the teeth 11, which occurs approximately at receiving point 13, and passes through the air curtain 16, which tends to blow any neps which may also be propelled along the ejection path 15, back against the surface 14 of the cylinder 10. The trash then travels through the dead air space 22 and into the trash receiving volume 24, where it is entrained by the trash air stream 26, and conducted away. The dead air space 22 tends to prevent the trash which is in the trash removal volume 24 from re-contacting and being drawn along with the air curtain 16.

Figure 2:
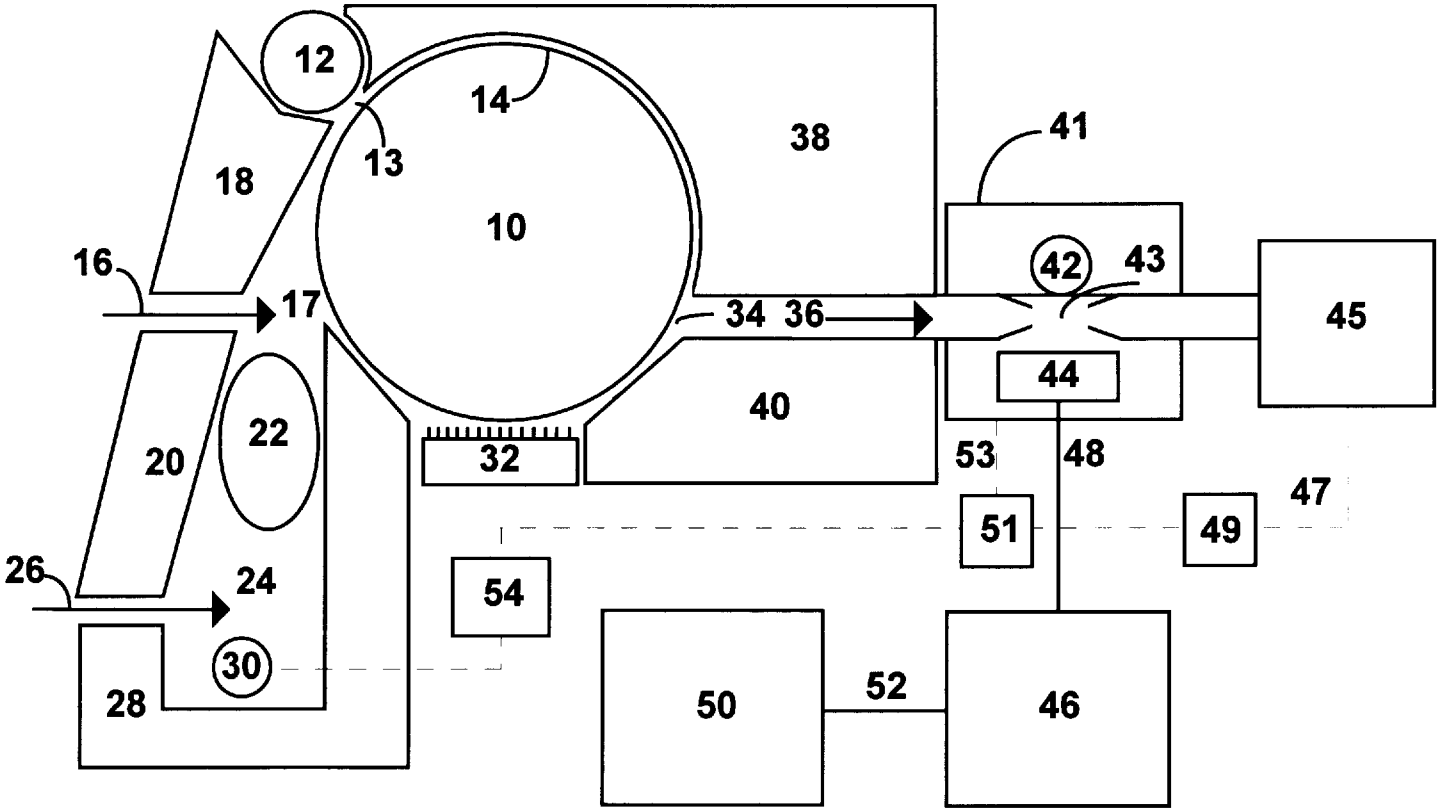
FIG. 2 depicts an embodiment of the invention.

The neps, now substantially free of trash, continue along the surface 14 of the cylinder 10 as it rotates. Preferably, a carding flat 32, as depicted in FIG. 2, disposed at a position between the fiber sample receiving point 13 and a nep release point 34, cards the neps as they are drawn along with the rotation of the cylinder 10. The neps are drawn off the surface 14 of the cylinder 10 at the nep release point 34 by a nep air stream 36, such as defined between blocks 38 and 40, which nep air stream 36 entrains the neps.

The neps in the nep air stream 36 are presented to an enclosure 41, in which a sensor detects the neps at point 43. In the preferred embodiment depicted in FIG. 2, the sensor has a light source 42 disposed adjacent the nep air stream 36. The light source 42 illuminates the neps entrained in the nep air stream 36 in a transverse direction. The neps in the nep air stream 36 cast shadows in the illumination, which shadows have an amplitude component and a time duration component. For example, a shadow cast by a longer nep will last longer than that cast by a shorter nep. This is the time duration component of the shadow. Similarly, a shadow cast by a denser nep will have a larger amplitude than that cast by a less dense nep. This is the amplitude component of the shadow. Together, the time duration component and the amplitude component of the shadow tend to provide an indication of the type of entity casting the shadow.

A light detector 44 is preferably disposed adjacent the nep air stream 36, across from the light source 42. The light detector 44 detects the illumination from the light source 42 and the shadows cast by the neps in the illumination, and produces nep detection signals corresponding to the amplitude and time duration components of the shadows. Thus, the nep detection signals also have amplitude and time duration components.

The nep detection signals are sent on lines 48 to an output means 46. Preferably, output means 46 includes a transimpedance amplifier with a gain of about 100,000 volts/amp, a bandpass filter, a threshold comparator with the threshold set to about 1.7 volts, a pulse width timer with a resolution of about 0.1 microseconds, a peak detector, an 8-bit analog to digital converter, and a microcomputer to implement the nep detection method, count the neps, and display the result.

The output means 46 receive the nep detection signals and compare the amplitude and time duration components of the nep detection signals against predetermined limits. If the amplitude component is sufficiently large to equal or exceed a first predetermined limit, and the time duration component does not exceed a second predetermined limit, then the output means determines that a nep has been detected. If the amplitude component does not equal or exceed the first predetermined limit, and the time duration component exceeds the second predetermined limits, then the output means determines that the signals are not associated with a nep.

In the preferred embodiment, the second predetermined limit of the time component is between about 20–50 microseconds at the 1.7 volt hardware threshold, and the first predetermined limit of the amplitude component is between about 2.2–2.5 volts. The predetermined limits are preferably user adjustable so that the nep detector may be configurable for different applications. For example, if it is important that as many neps as possible be detected, at the risk of possibly incorrectly identifying some of the fibers as neps, then the first predetermined limit may be adjusted to a lower value, or the second predetermined limit may be adjusted to higher values. On the other hand, if it is important that no fibers be incorrectly identified as neps, at the risk of excluding some neps from detection, then the first predetermined limit may be adjusted to a higher value, or the second predetermined limit may be adjusted to a lower value. Most preferably there is a setting for the amplitude and time component predetermined limits where all of the neps are detected, but none of the fibers are detected.

Fibers from the fiber sample may still be mixed in with the neps at the point 43 where the sensor takes its readings. However, the fibers tend to not exceed the predetermined limits as described above. There are at least two reasons for this. First, the apparatus tends to individualize the fibers, which tend to be smaller than the entangled mass of fibers which make up a nep. Second, the apparatus tends to break the fibers, making them even smaller than they typically would be. Thus, the operating conditions of the separation and detection apparatus, as described above, aid in the detection of neps in the fiber sample.

The output means 46 preferably increments a count of neps detected when the output means 46 determine that a nep has been detected, as described above. In a preferred embodiment, the output means 46 sends a tally of the count across wire 52 to a display 50, where the nep count is presented to an operator.

The air curtain 16, nep air stream 36, and trash air stream 26 are preferably all created with a vacuum source 45, such as a vacuum pump. The vacuum source draws the nep air stream 36 away from the cylinder 10 and toward the vacuum source 45. This draws in an air stream from the port defined by blocks 18 and 20. Thus, by adjusting the amount of vacuum provided by the vacuum source 45, the flow of the air curtain 16 can be controlled.

The vacuum source 45 is also tied to port 30, such as through adjustment valve 49 and vacuum line 47. The vacuum applied at port 30 will draw in the trash air stream 26 through the port defined between blocks 20 and 28. By adjusting the relative amount of vacuum applied on port 30 by adjusting valve 49 and the size of port 30, and by adjusting the size of the two ports defined between blocks 18 and 20 and blocks 20 and 28, all of the air curtain 16 will flow around the cylinder 10 at point 17, and all of the trash air stream 26 will flow out of the port 30. When these two air streams 16 and 26 flow out in separate directions as described, the dead air space 22 is created.

These air flows 16 and 26 can then be adjusted together so that the trash propelled by the cylinder 10 has enough momentum to go through the air curtain 16, but the neps tend to be blown back toward the cylinder 10 by the air curtain 16. Alternately, the rotational speed of the cylinder 10 can be adjusted to achieve the same result. For example, if the trash in not being propelled with sufficient momentum to travel through the air curtain 16, the speed of the cylinder 10 can be increased until the trash does have sufficient momentum, or the vacuum can be reduced so that the air curtain 16 does not have as much flow. If the fiber sample is being impacted by the teeth 11 of the cylinder 10 with so much force that the neps are tending to have sufficient momentum to cross the air curtain 16, then the rotational speed of the cylinder 10 can be decreased until the neps are drawn along the surface of the cylinder 10, or the vacuum can be increased so that the air curtain 16 has more flow. Of course, as mentioned above, whenever the flow of the air curtain 16 is adjusted, the flow of the trash air stream 26 is also preferably adjusted, so as to maintain the dead air space 22.

Thus, there is a relationship between the amount of vacuum applied on the nep air stream 36 and the port 30, and the rotational speed of the cylinder 10. The relationship between the nep air stream 36 and the port 30 defines the dead air space 22, and the relationship between the air curtain 16 and the speed of the cylinder 10 defines how much of the trash and neps pass through the air curtain 16.

The trash conducted away through port 30 may also be sensed and analyzed in a manner similar to that described above for the neps. For example the trash may be sent to a sensor 54 similar to that described, or even to the same sensor by routing the trash through valve 51 and line 53.

While specific embodiments of the invention have been described with particularity above, it will be appreciated that the invention comprehends rearrangement and substitution of parts within the spirit of the appended claims.

What is claimed is:

1. A nep separator and detector, comprising:

means for presenting a fiber sample having fibers, neps, and trash, a toothed rotating cylinder for receiving the fiber sample at a fiber sample receiving point, and for impacting and propelling at least a portion of the trash and neps along an ejection path, an air curtain directed toward and passing across a portion of the toothed surface of the rotating cylinder at a location rotationally after the fiber sample is received by the toothed rotating cylinder, the air curtain crossing and being oriented transverse to the ejection path, for drawing at least a quantity of the portion of the neps out of the ejection path and onto the surface of the toothed cylinder as it rotates, the trash propelled by impact with the toothed rotating cylinder having sufficient momentum to pass through the air curtain along the ejection path, a dead air space disposed adjacent the air curtain and across the air curtain from the fiber sample receiving point, and positioned in the ejection path, through which the trash propelled by the toothed rotating cylinder passes, a nep air stream for drawing the neps on the surface of the toothed cylinder off the surface of the toothed cylinder at a nep release point and entraining the neps, a sensor for detecting the neps entrained in the nep air stream, and producing a nep detection signal upon the occurrence of each detection of a nep, and output means for receiving the nep detection signals produced by the sensor and producing output signals corresponding to the nep detection signals.

2. The nep separator and detector of claim 1, further comprising:

a trash removal volume disposed adjacent the dead air space and across the dead air space from the air curtain at a location along the ejection path, for receiving the trash passing through the dead air space, and a trash air stream entering the trash removal volume for entraining the trash received in the trash removal volume, and for exiting the trash removal volume with the trash entrained in the trash air stream, and for conducting the trash entrained in the trash air stream out of the trash removal volume.

3. The nep separator and detector of claim 2, further comprising a trash sensor for selectively detecting the trash entrained in the trash air stream.

4. The nep separator and detector of claim 1, wherein the means for presenting the fiber sample further comprises a rotating feed roller disposed proximate the toothed rotating cylinder, the rotating feed roller and the toothed rotating cylinder both rotating in the same direction, such that adjacent surfaces of the rotating feed roller and the toothed rotating cylinder pass each other in opposite directions.

5. The nep separator and detector of claim 1, wherein the teeth on the toothed rotating cylinder are disposed at an angle forward from normal relative to the direction of rotation of the toothed rotating cylinder.

6. The nep separator and detector of claim 1, wherein the toothed rotating cylinder has a solid surface.

7. The nep separator and detector of claim 1, wherein the speed of rotation of the toothed rotating cylinder is about 6,000 rotations per minute.

8. The nep separator and detector of claim 1, further comprising a carding flat disposed adjacent the toothed rotating cylinder at a position between the fiber sample receiving point and the nep release point, for carding the neps drawn along the surface of the toothed cylinder.

9. The nep separator and detector of claim 1, wherein the sensor further comprises:

a light source disposed adjacent the nep air stream, for illuminating in a transverse direction the neps entrained in the nep air stream, the neps casting shadows in the illumination having an amplitude component and a time duration component, and a light detector disposed adjacent the nep air stream and across the nep air stream from the light source, for detecting the illumination and the shadows in the illumination cast by the neps, and for producing the nep detection signals corresponding to the amplitude and time duration components.

10. The nep separator and detector of claim 9, wherein the output means further comprise means for comparing the amplitude and time duration components of the nep detection signals against predetermined limits, and for incrementing a count of neps detected when the amplitude component of the nep detection signals is at least equal to a first predetermined limit and the time duration component of the nep detection signals is no greater than a second predetermined limit.

11. A nep separator and detector, comprising:

means having a rotating feed roller, for presenting a fiber sample having fibers, neps, and trash, a toothed rotating cylinder disposed proximate the rotating feed roller, the rotating feed roller and the toothed rotating cylinder both rotating in the same direction, such that adjacent surfaces of the rotating feed roller and the toothed rotating cylinder pass each other in opposite directions, the teeth on the toothed rotating cylinder disposed at an angle forward from normal relative to the direction of rotation of the toothed rotating cylinder, the toothed rotating cylinder having a solid surface, the toothed rotating cylinder for receiving the fiber sample at a fiber sample receiving point, and for impacting and propelling at least a portion of the trash and neps along an ejection path, an air curtain directed toward and passing across a portion of the toothed surface of the rotating cylinder at a location rotationally after the fiber sample is received by the toothed rotating cylinder, the air curtain crossing and being oriented transverse to the ejection path, for drawing at least a quantity of the portion of the neps out of the ejection path and onto the surface of the toothed cylinder as it rotates, the trash propelled by the toothed rotating cylinder having sufficient momentum to pass through the air curtain along the ejection path, a dead air space disposed adjacent the air curtain and across the air curtain from the fiber sample receiving point, and positioned in the ejection path, through which the trash propelled by the toothed rotating cylinder passes, a trash removal volume disposed adjacent the dead air space and across the dead air space from the air curtain at a location in the ejection path, for receiving the trash passing through the dead air space, a trash air stream entering the trash removal volume for entraining the trash received in the trash removal volume, and for exiting the trash removal volume with the trash entrained in the trash air stream, and for conducting the trash entrained in the trash air stream out of the trash removal volume, a nep air stream for drawing the neps on the surface of the toothed cylinder off the surface of the toothed cylinder at a nep release point and entraining the neps, a carding flat disposed adjacent the toothed rotating cylinder at a position between the fiber sample receiving point and the nep release point, for carding the neps drawn along the surface of the toothed cylinder, a sensor for detecting the neps entrained in the nep air stream, the sensor having; a light source disposed adjacent the nep air stream, for illuminating in a transverse direction the neps entrained in the nep air stream, the neps casting shadows in the illumination having an amplitude component and a time duration component, and a light detector disposed adjacent the nep air stream and across the nep air stream from the light source, for detecting the illumination and the shadows in the illumination cast by the neps, and for producing nep detection signals corresponding to the amplitude and time duration components; and output means for receiving the nep detection signals produced by the sensor, and for comparing the amplitude and time duration components of the nep detection signals against predetermined limits, and for incrementing a count of neps detected when the amplitude component of the nep detection signals is at least equal to a first predetermined limit and the time duration component of the nep detection signals is no greater than a second predetermined limit.

12. The nep separator and detector of claim 11, further comprising a trash sensor for selectively detecting the trash entrained in the trash air stream.

13. A method of separating and detecting neps in a fiber sample having fibers, neps, and trash, comprising:

presenting the fiber sample with a fiber sample presenting means, receiving the fiber sample with a propelling means at a fiber sample receiving point, propelling at least a portion of the trash and neps along an ejection path with the propelling means, orienting an air curtain transverse to the ejection path, the air curtain crossing the ejection path, drawing at least a quantity of the portion of the neps in the fiber sample out of the ejection path and into a nep air stream, the trash being propelled with sufficient momentum to pass through the air curtain along the ejection path, the trash thereby passing through a dead air space disposed adjacent the air curtain and across the air curtain from the fiber sample receiving point, and positioned in the ejection path, detecting the neps entrained in the nep air stream with a sensor, and producing a nep detection signal upon the occurrence of each detection of a nep.

14. A method of separating and detecting neps in a fiber sample having fibers, neps, and trash, comprising:

a) presenting the fiber sample with a fiber sample presenting means, b) receiving the fiber sample with a toothed rotating cylinder at a fiber sample receiving point, c) propelling at least a portion of the trash and neps along an ejection path with the teeth of the rotating cylinder, d) orienting an air curtain transverse to the ejection path, the air curtain crossing the ejection path, e) directing the air curtain toward and passing the air curtain across a portion of the toothed surface of the rotating cylinder at a location rotationally after the fiber sample is received by the toothed rotating cylinder, f) drawing at least a quantity of the portion of the neps in the fiber sample out of the ejection path and onto the surface of the toothed cylinder as it rotates, g) the trash being propelled with sufficient momentum to pass through the air curtain along the ejection path, h) the trash thereby passing through a dead air space disposed adjacent the air curtain and across the air curtain from the fiber sample receiving point, and positioned in the ejection path, i) drawing the neps on the surface of the toothed cylinder off the surface of the toothed cylinder with a nep air stream at a nep release point, j) entraining the neps drawn off the surface of the toothed cylinder in the nep air stream, k) detecting the neps entrained in the nep air stream with a sensor, and l) producing a nep detection signal upon the occurrence of each detection of a nep.

15. The method of claim 14 further comprising:

m) receiving the trash passing through the dead air space in a trash removal volume disposed adjacent the dead air space and across the dead air space from the air curtain in the ejection path, n) entraining the trash received in the trash removal volume with a trash air stream, and o) conducting the trash entrained in the trash air stream out of the trash removal volume.

16. The method of claim 14 further comprising:

m) carding the neps on the surface of the toothed rotating cylinder with a carding flat disposed adjacent the toothed rotating cylinder at a position between the fiber sample receiving point and the nep release point.

17. The method of claim 14 wherein the step of detecting the neps entrained in the nep air stream with the sensor and the step of producing the nep detection signals further comprise:

illuminating in a transverse direction the neps entrained in the nep air stream with a light source disposed adjacent the nep air stream, the neps thereby casting shadows in the illumination, the shadows having an amplitude component and a time duration component, detecting the illumination and the shadows in the illumination cast by the neps with a light detector disposed adjacent the nep air stream and across the nep air stream from the light source, and producing the nep detection signals with the light detector, corresponding to the amplitude and time duration components.

18. The method of claim 17 further comprising:

m) comparing the amplitude and time duration components of the nep detection signals against predetermined limits, and n) incrementing a count of neps detected when the amplitude component of the nep detection signals is at least equal to a first predetermined limit and the time duration component of the nep detection signals is no greater than a second predetermined limit.

19. A method of separating and detecting neps in a fiber sample having fibers neps, and trash, comprising:

presenting the fiber sample with a fiber sample presenting means, receiving the fiber sample with a toothed rotating cylinder at a fiber sample receiving point, propelling at least a portion of the trash and neps along an ejection path with the teeth of the rotating cylinder, orienting an air curtain transverse to the ejection path, the air curtain crossing the ejection path, directing the air curtain toward and passing the air curtain across a portion of the toothed surface of the rotating cylinder at a location rotationally after the fiber sample is received by the toothed rotating cylinder, drawing at least a quantity of the portion of the neps in the fiber sample out of the ejection path and onto the surface of the toothed cylinder as it rotates, the trash being propelled with sufficient momentum to pass through the air curtain along the ejection path, the trash thereby passing through a dead air space disposed adjacent the air curtain and across the air curtain from the fiber sample receiving point, and positioned in the ejection path, receiving the trash passing through the dead air space in a trash removal volume disposed adjacent the dead air space across from the air curtain along the ejection path, entraining the trash received in the trash removal volume with a trash air stream, conducting the trash entrained in the trash air stream out of the trash removal volume, carding the neps drawn along the surface of the toothed rotating cylinder with a carding flat disposed adjacent the toothed rotating cylinder, drawing the neps on the surface of the toothed cylinder off the surface of the toothed cylinder with a nep air stream at a nep release point, entraining the neps drawn off the surface of the toothed cylinder in the nep air stream, illuminating in a transverse direction the neps entrained in the nep air stream with a light source disposed adjacent the nep air stream, the neps thereby casting shadows in the illumination, the shadows having an amplitude component and a time duration component, detecting the illumination and the shadows in the illumination cast by the neps with a light detector disposed adjacent the nep air stream and across the nep air stream from the light source, producing the nep detection signals with the light detector, corresponding to the amplitude and time duration components, comparing the amplitude and time duration components of the nep detection signals against predetermined limits, and incrementing a count of neps detected when the amplitude component of the nep detection signal is at least equal to a first predetermined limit and the time duration component of the nep detection signals is no greater than a second predetermined limit.

* * * * *